US007517032B2

(12) United States Patent
Nottelman et al.

(10) Patent No.: US 7,517,032 B2
(45) Date of Patent: Apr. 14, 2009

(54) APPARATUS AND METHOD FOR CONTROLLING THE PRESSURE IN AN INK RESERVOIR OF AN INK JET PRINTER

(75) Inventors: Frank J. H. Nottelman, Belfeld (NL); Jeroen J. M. Hennissen, Ospel (NL)

(73) Assignee: Oce-Technologies, Venlo (NL)

( * ) Notice: Subject to any disclaimer, the term of this patent is extended or adjusted under 35 U.S.C. 154(b) by 326 days.

(21) Appl. No.: 11/285,185

(22) Filed: Nov. 23, 2005

(65) Prior Publication Data

US 2006/0109321 A1 May 25, 2006

(30) Foreign Application Priority Data

Nov. 25, 2004 (EP) ..... 04106060

(51) Int. Cl.
*B41J 29/38* (2006.01)
*B41J 2/175* (2006.01)

(52) U.S. Cl. ..... 347/5; 347/85

(58) Field of Classification Search ..... 347/5, 347/19, 84, 85; 141/114; 222/255, 621, 222/635

See application file for complete search history.

(56) References Cited

U.S. PATENT DOCUMENTS 4,910,529 A * 3/1990 Regnault ..... 347/6
5,681,152 A * 10/1997 Åhs ..... 417/413.2
5,967,045 A 10/1999 Staiger et al.
6,030,074 A * 2/2000 Barinaga ..... 347/85
6,290,343 B1 9/2001 Lewis et al.
6,663,233 B2 * 12/2003 Otsuka et al. ..... 347/85
6,811,249 B2 * 11/2004 DeVries et al. ..... 347/85
7,077,513 B2 * 7/2006 Kimura et al. ..... 347/85
7,240,999 B2 * 7/2007 Kumagai et al. ..... 347/85
7,261,399 B2 * 8/2007 Miki ..... 347/85
2002/0089576 A1 7/2002 Ishizawa et al.
2002/0097284 A1 7/2002 Vosahlo
2004/0212666 A1 10/2004 Hoen et al.

FOREIGN PATENT DOCUMENTS

EP 0 983 857 A1 3/2000
EP 1 038 680 A2 9/2000
EP 1 415 816 A1 5/2004
JP 2003-226022 A 8/2003
JP 2003-300331 A 10/2003
JP 2003-341028 A 12/2003

* cited by examiner

*Primary Examiner*—Anh T. N. Vo
(74) *Attorney, Agent, or Firm*—Birch, Stewart, Kolasch & Birch, LLP

(57) ABSTRACT

An apparatus for controlling the pressure in an ink reservoir of an ink jet printer which includes at least one ink reservoir of an ink jet printer, a pressure applying device for applying a pressure in the ink reservoir, the pressure applying device communicating with the ink reservoir via a first conduit, a buffer reservoir communicating a gasteous medium with the ink reservoir via a second conduit different from the first conduit, a detection system for monitoring the actual pressure in the ink reservoir, the detection system including at least one electronic pressure sensor, and a controller for controlling the pressure applying means dependent on the actual pressure monitored by the detection system.

6 Claims, 2 Drawing Sheets

APPARATUS AND METHOD FOR CONTROLLING THE PRESSURE IN AN INK RESERVOIR OF AN INK JET PRINTER

BACKGROUND OF THE INVENTION

The present invention relates to an apparatus for controlling pressure in an ink reservoir of an ink jet printer. The present invention also relates to an ink jet printer including a printhead with an ink reservoir containing liquid ink and a gas volume above the level of the ink. The present invention further relates to a method for controlling pressure in an ink reservoir of an ink jet printer.

An ink jet printer typically contains printheads having one or more nozzle arrays and an ink reservoir from which liquid ink is supplied to the nozzles of the nozzle arrays, so that ink droplets may be ejected from the nozzles by thermal or piezoelectric action, as is generally known in the art. When the level of ink in the ink reservoir is higher than the level of the nozzles, the ink reservoir should be maintained at subatmospheric pressure in order to avoid ink from leaking out through the nozzles. Since the difference between the internal pressure in the ink reservoir and the atmospheric pressure has an influence on the process of droplet generation and hence on the quality of the printed image, it is desirable to keep this pressure difference constant. However, since the internal pressure in the ink reservoir may vary in response to changes of the ink volume contained therein, thermal expansion and the like, it is necessary to control the internal pressure in the ink reservoir.

It is common to apply pressure regulating valves coupled to a pump for allowing compensation of an excessive pressure drop monitored by the detecting means in order to maintain the under pressure in the ink reservoir within a certain predetermined pressure range. Pressure regulating valves however are commonly, relatively expensive and sensitive. Thus, relatively large membranes are required to achieve a relatively high degree of precision in the regulation of the pressure within the ink reservoir. Furthermore, commonly other critical components are required, often resulting in a relatively high mutual friction and are therefore often subjected to a considerable amount of wear. Rubber parts commonly used in the known apparatus to control the pressure within the ink reservoir become fatigued relatively quickly, resulting in a decreased capacity to counteract loads during operation of the apparatus. Thus, the known device is, from a constructive point of view, relatively complex and hence, relatively expensive. Moreover, the components used in the known device are commonly subjected to a considered amount of wear during operational use.

SUMMARY OF THE INVENTION

Accordingly, it is an object of the present invention to provide a relatively simple and durable device for controlling the pressure in an ink reservoir of an inkjet printer.

This object can be achieved by providing, according to the present invention, an apparatus for controlling pressure in an ink reservoir of an ink jet printer, the apparatus including: pressure applying means for applying a certain pressure in the ink reservoir, detecting means for monitoring the actual pressure in the ink reservoir, the detecting means containing at least one electronic pressure sensor and controlling means for controlling the pressure applying means, dependent on the actual pressure monitored by the detecting means. The electronic pressure sensor can electronically detect an underpressure and/or an overpressure in a relatively simple though painstaking manner. To this end, no complex system and moving components are required to accurately measure the pressure of a gaseous fraction in the ink reservoir. This elimination of components reduces the frictional wear of the components and hence increases the life span of the low-maintenance apparatus. Moreover, since no complex (moving) components are used, the cost price of the apparatus can be reduced significantly. It is noted that commonly an underpressure is applied within the ink reservoir to prevent uncontrolled drop-out of ink from the nozzles. However, in certain circumstances it is though advantageous to apply a certain overpressure within the ink reservoir for cleaning purposes. Both pressures (underpressure and overpressure) can be detected by the electronic pressure sensor, which is commonly not possible by means of the conventional mechanical (one-way) detecting means, the latter commonly being able to detect merely an underpressure. The expressions overpressure and underpressure are relative expressions relating to the pressure surrounding the apparatus, and in particular the nozzles. Commonly, a single electronic pressure sensor will be applied to monitor simultaneously the underpressure in all printheads. However, it is also conceivable to apply multiple electronic pressures to monitor the pressure in multiple parts of the apparatus according to the present invention. To this end, it is possible to utilize multiple electronic pressure sensors, wherein each electronic pressure sensor is in communication with a printhead provided with a specific colored ink. It is also possible to apply multiple electronic pressure sensors, wherein a second electronic pressure sensor forms a backup sensor for a first electronic pressure sensor in case the first electronic pressure sensors fails.

The pressure applying means can be adapted to generate a certain underpressure and/or a certain overpressure within the ink reservoir. Thereby, the pressure applying means can be formed in various ways. Preferably, the pressure applying means includes at least one pump, more preferably a pump in which the capacity thereof is adjustable. The capacity of the pump can be adjusted by applying variable frequencies and/or voltages, wherein by means of an electromagnet the moving speed of a plunger of the pump can be adjusted. The pump is preferably formed as a membrane pump or any other pump in which the output can be regulated electronically. The specifications of the pump can be chosen by a person skilled in the art dependent on the situational conditions of the apparatus of the present to the invention. For example, a (membrane) pump can be applied with a pump discharge of about one liter per minute to achieve a pressure of from 0 to 300 millibar. However, as mentioned above, the underpressure in the ink reservoir during operational use is rather critical and is normally placed between 5 and 50 millibar with an allowed deviation of certain millibars dependent on the desired underpressure in the ink reservoir.

In a preferred embodiment the pressure applying means includes at least one buffer reservoir. The buffer reservoir is adapted to enclose a (gaseous) medium with a certain (under) pressure which communicates with the gaseous volume within the ink reservoir. In this manner it is also possible to achieve a desired underpressure and/or overpressure in the ink reservoir without making use of a conventional pump. The volume of the buffer reservoir can be either constant, preferably of between 1 and 20 liter, or can be adjustable. In the latter embodiment the capacity of the buffer reservoir can be adjusted, for example by means of a plunger. In a particular preferred embodiment the buffer reservoir is positioned between the ink reservoir and the pump. In this case, the buffer reservoir can be applied to absorb pumping pulses generated by the pump to avoid (extreme) fluctuations of the internal pressure within the ink reservoir. Moreover, the buffer reservoir can act as a surrogate pump in case the actual pump is turned off for example due to a power breakdown, or in case the actual pump is temporary switched to a standby mode, for example between two print sessions. Preferably, the buffer reservoir is isolatable from the communication between the pump and the ink reservoir, for example in case where a temporary overpressure needs to be applied to the ink reservoir for rinsing the ink reservoir. Isolation of the buffer reservoir from the pump and the ink reservoir can be realized by means of a switch, in particular a pneumatic or even a hydraulic or electronic switch. In an alternative embodiment it is conceivable to apply multiple buffer reservoirs, wherein, for example, each printhead may be in communication with a separate buffer reservoir. In this manner, the pressure per printhead can be regulated more precisely and even independent of the pressures prevailing in the other printheads.

While the printhead of an ink jet printer is generally mounted on a moving carriage, the pressure control apparatus is preferably mounted on a stationary frame of the printer and is preferably connected to the ink reservoir on the printhead through a flexible hose. Application of a flexible hose commonly increases the degree of freedom of design of the inkjet printer, whereas the deformation of the hose will easily be adapted to the mutual orientation of the printhead(s) on one side and the apparatus according to the present invention on the other side. If the printhead contains a plurality of ink reservoirs, for example in a color printer, all ink reservoirs may, not necessarily be connected to the same pressure control apparatus.

In a preferred embodiment the pressure control apparatus is mounted on a moving carriage of the printer, and the pressure applying means for withdrawing or adding gas to the ink reservoir is driven by the relative movement of the carriage and supporting structure of the printer carrying the moving carriage. In this manner a relatively advantageous printer construction can be obtained.

The present invention further relates to a method for controlling the pressure in an ink reservoir of an ink jet printer, including the steps of: A) applying a certain pressure to an ink reservoir by a pressure applying means communicating with the ink reservoir, B) electronically monitoring the actual pressure in the ink reservoir by a electronic pressure sensor, and C) adjusting the pressure monitored by the electronic pressure sensor in the case where the monitored pressure exceeds a certain value.

BRIEF DESCRIPTION OF THE DRAWINGS

The present invention can further be illustrated by reference to the drawing, wherein.

DETAILED DESCRIPTION OF THE INVENTION

Figure 1:
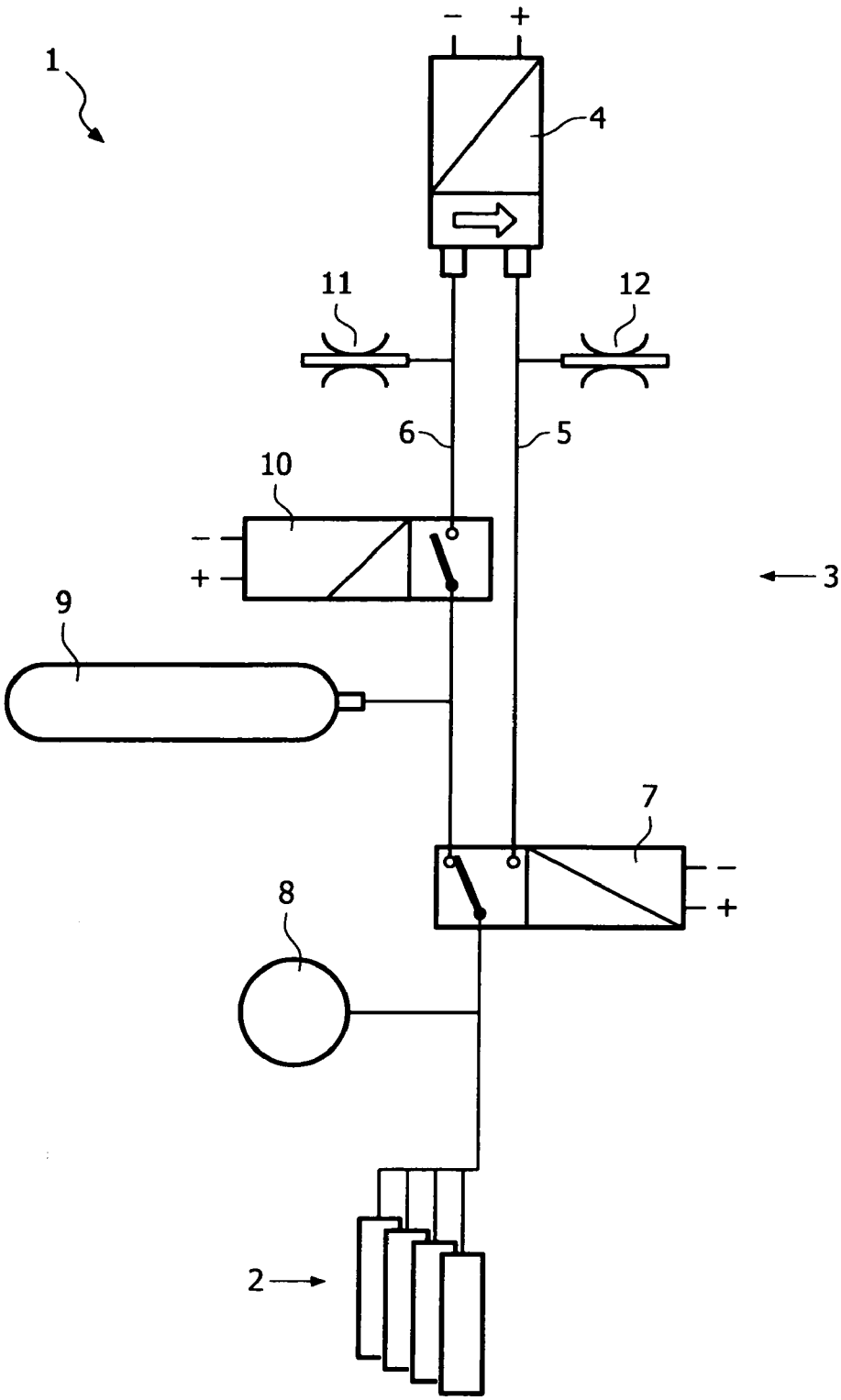
FIG. 1 shows a schematic view of an assembly of multiple printheads and an apparatus for controlling the pressure in the printheads, according to the present invention.

FIG. 1 shows a schematic view of a preferred embodiment of an assembly 1 of multiple printheads 2 and an apparatus 3 for controlling the pressure in the printheads according to the present invention. The apparatus 3 includes a membrane pump 4, the capacity of which can be adjusted by applying variable frequencies to the pump 4. The pump 4 is adapted to generate an overpressure and/or an underpressure and is in communication with ink reservoirs incorporated in the printheads 2. Both an overpressure conduit 5 and an underpressure conduit 6 are coupled to a diverter valve 7, the latter being adapted to apply either an overpressure or an underpressure in the ink reservoirs of the printheads. Under normal printing conditions a critical underpressure in the ink reservoirs is required of about between 5 and 20 millibar, wherein the diverter valve 7 is switched such, that the ink reservoirs are in communication with the underpressure conduit 6, and wherein the overpressure conduit 5 is dead-ended (not connected). Between the diverter valve 7 and the printheads 2 an electronic pressure sensor 8 is provided to electronically detect the pressure in the ink reservoirs. Electronically detecting the internal pressure within the ink reservoirs is constructively, relatively simple, relatively durable, and therefore relatively cheap. The apparatus 3 further includes a control unit (not shown) for controlling the pump capacity of the membrane pump 4 dependent on the pressure in the ink reservoir, as monitored by the electronic pressure sensor 8. The underpressure conduit 6 is in communication with a buffer chamber 9 with a predetermined volume of preferably between 1 and 20 liter. The buffer chamber 9 encloses a vacuum space having a multilateral functionality. The buffer chamber 9 is adapted to substantially absorb (under)pressure pulses generated by the membrane pump 4, such that undesired pressure fluctuations in the ink reservoirs can be prevented. Moreover, the buffer chamber 9 can act as an autonomous suction device for, at least temporarily, maintaining the critical underpressure in the ink reservoirs in case the membrane pump 4 is not running, for example due to a power breakdown. The buffer chamber 9 can be fully isolated by means of the diverter valve 7 on the one side and a non-leakage valve 10, the latter being positioned in the underpressure conduit 6 between the pump 4 and the buffer chamber 9. In the case of a power breakdown, or at least in the case where the membrane pump 4 is turned off during a printing operation, the non-leakage valve 10 can be switched, thereby disconnecting the membrane pump 4 from the printheads 2, and hence preventing the leakage of gas, preferably air, from the buffer chamber 9 to the membrane pump 4. During a printing operation the diverter valve 7 is already switched towards the underpressure conduit 6, as a result of which the critical underpressure in the ink reservoirs can be maintained, at least temporary. Switching the diverter valve 7 and the non-leakage valve 10 can be realized either pneumatically, hydraulically or electronically by the control unit. The apparatus 3 further contains an underpressure restriction 11 to prevent excessive underpressure in the ink reservoirs during printing, and an overpressure restriction 12 to prevent excessive overpressure in the ink reservoirs during purging.

Figure 2:
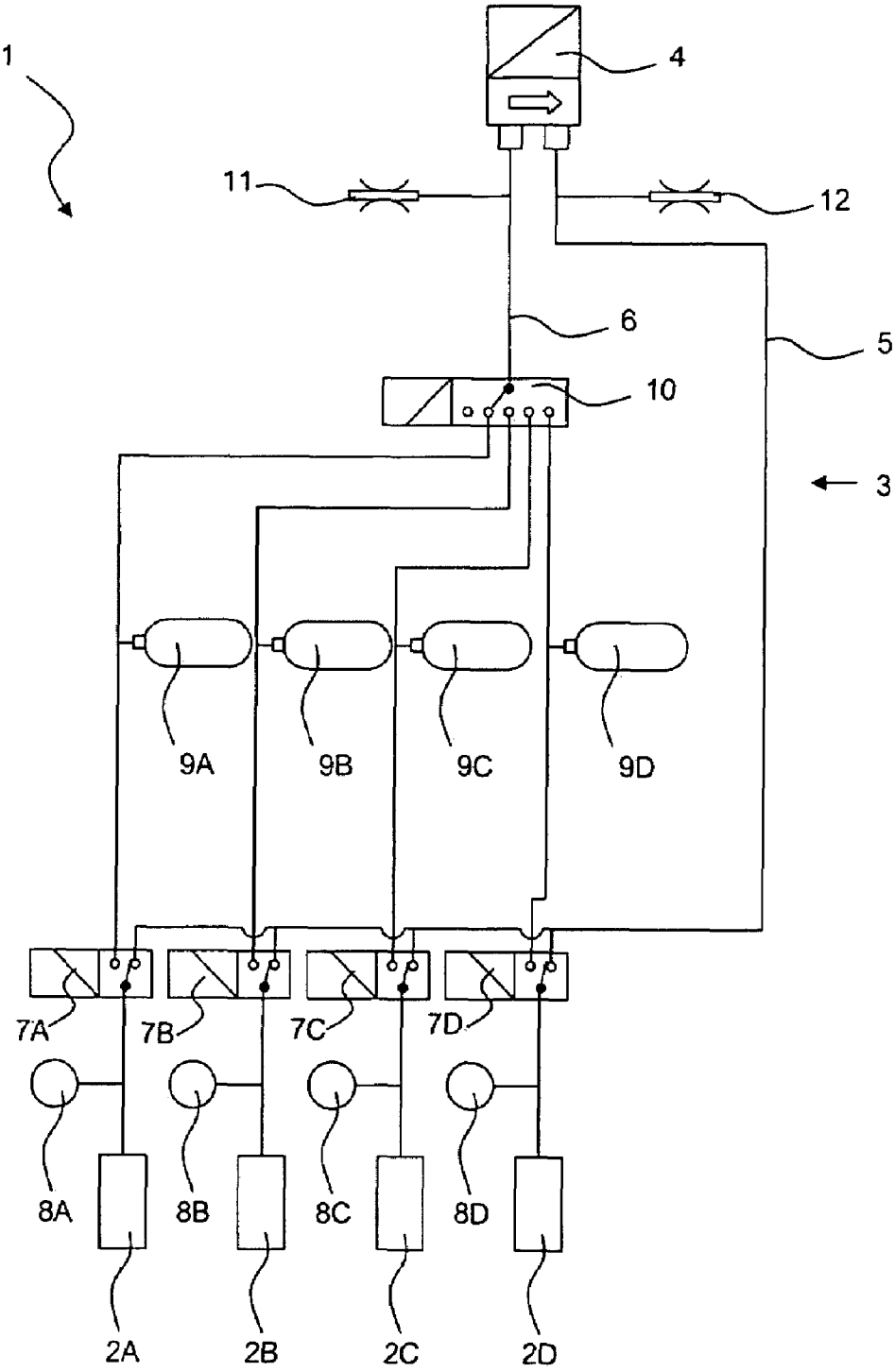
FIG. 2 shows, in a schematic view, a plurality of printheads in communication with separate buffer reservoirs.

FIG. 2 shows the feature of the present invention wherein multiple buffer reservoirs 9A-9D are utilized so that each printhead 2A-2D may be in communication with a separate buffer reservoir. Separate diverter valves 7A-7D are in separate communication with the overpressure conduit 5 and the underpressure conduit 6. Electronic pressure sensors 8A-8B are also operatively associated with respective printheads 2A to 2D.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for controlling the pressure in an ink reservoir of an ink jet printer, which comprises:

at least one ink reservoir of an ink jet printer, pressure applying means for applying a pressure in the ink reservoir, the pressure applying means communicating with the ink reservoir via a first conduit, a buffer reservoir communicating a gaseous medium with the ink reservoir via a second conduit different from the first conduit, said second conduit connecting the buffer reservoir with the first conduit at a location between the pressure applying means and the ink reservoir;

detecting means for monitoring the actual pressure in the ink reservoir, the detecting means including at least one electronic pressure sensor, and controlling means for controlling the pressure applying means dependent on the actual pressure monitored by the detecting means.

2. The apparatus according to claim 1, wherein the said pressure applying means is at least one pump, the capacity of the pump being adjustable.

3. The apparatus according to claim 2, wherein the pump is a membrane pump.

4. The apparatus according to claim 1, wherein the volume of the buffer reservoir is adjustable.

5. An ink jet printer which comprises a printhead provided with an ink reservoir containing liquid ink and a gas volume disposed above the level of the ink, wherein the gas volume is connected to the apparatus for controlling the pressure in the ink reservoir according to claim 1.

6. An apparatus for controlling the pressure in an ink reservoir of an ink jet printer, which comprises:

at least one ink reservoir of an ink jet printer, pressure applying means for applying a pressure in the ink reservoir, the pressure applying means communicating with the ink reservoir via a first conduit, a buffer reservoir communicating a gaseous medium with the ink reservoir via a second conduit different from the first conduit, the volume of the buffer reservoir being adjustable, detecting means for monitoring the actual pressure in the ink reservoir, the detecting means including at least one electronic pressure sensor, and controlling means for controlling the pressure applying means dependent on the actual pressure monitored by the detecting means.

* * * * *